United States Patent [19]

Güntert et al.

[11] Patent Number: 4,830,587

[45] Date of Patent: May 16, 1989

[54] FUEL INJECTION PUMP FOR INTERNAL COMBUSTION ENGINES

[75] Inventors: Josef Güntert, Gerlingen; Walter Häfele, Fellbach; Johann Warga, Bietigheim-Bissingen, all of Fed. Rep. of Germany

[73] Assignee: Robert Bosch GmbH, Stuttgart, Fed. Rep. of Germany

[21] Appl. No.: 135,158

[22] PCT Filed: Mar. 20, 1987

[86] PCT No.: PCT/DE87/00125

§ 371 Date: Nov. 18, 1987

§ 102(e) Date: Nov. 18, 1987

[87] PCT Pub. No.: WO87/05665

PCT Pub. Date: Sep. 24, 1987

[30] Foreign Application Priority Data

Mar. 22, 1986 [DE] Fed. Rep. of Germany ..... 3609759

[51] Int. Cl.[4] ..... F02M 59/24

[52] U.S. Cl. ..... 417/499; 123/500

[58] Field of Search ..... 417/494, 499; 123/500, 123/501, 503

[56] References Cited

U.S. PATENT DOCUMENTS

| | | | |
|---|---|---|---|
| 2,890,657 | 6/1959 | May et al. | 417/499 X |
| 4,448,167 | 5/1984 | Schmid et al. | 123/503 X |
| 4,630,586 | 12/1986 | Guntert et al. | 123/503 X |
| 4,754,737 | 7/1988 | Ishida et al. | 123/501 X |

FOREIGN PATENT DOCUMENTS

| | | |
|---|---|---|
| 3428174 | 2/1986 | Fed. Rep. of Germany . |
| 2264975 | 10/1975 | France . |
| 604305 | 7/1948 | United Kingdom . |

*Primary Examiner*—Leonard E. Smith

*Attorney, Agent, or Firm*—Michael J. Striker

[57] ABSTRACT

A fuel injection pump for internal combustion engines has a reciprocated pump plunger (3) and a control slide (5), which is displaceable on the latter, and comprises a control borehole (28) which cooperates with a helical groove (15) on the pump plunger (3), the helical groove (15) communicates with the pump work space (26) via a duct (24, 25). For the purpose of controlling the start of delivery, the helical groove (15) communicates with a cylindrical counterbore (21) at the end area (22) remote of the pump work space. Moreover, the end area (23) of the control groove (15), which end area (23) is close to the pump work space, can communicate with a second counterbore in order to ensure a zero delivery when the helical grooves (15) are relatively flat.

8 Claims, 2 Drawing Sheets

FUEL INJECTION PUMP FOR INTERNAL COMBUSTION ENGINES

BACKGROUND OF THE INVENTION

The invention is based on a fuel injection pump.

Known injection pump (DE-OS 34 28 174), have a control recess in a pump plunger which has, in addition to a helical groove for controlling the end of delivery during the pressure stroke of the pump plunger, an elongated groove connected with it, whose end edge remote of the pump work space controls the start of delivery. Moreover, the elongated groove serves to completely cancel the injection delivery at a determined relative rotational position of the pump plunger and the control slide so as to stop the internal combustion engine in a reliable and rapid manner. Compared with previously known fuel injection pumps, considerable operating advantages are achieved with such a construction of a control recess in the pump plunger skirt; but it has the disadvantage that, because of the large surface of the control recess which is acted upon by the injection pressure during the pressure stroke of the pump plunger, the prevailing pressure also acts on the portion of the inside of the control slide which overlaps this surface. If the control slide has a relatively thin wall for reasons relating to construction space, a deformation of the control slide occurs with an increase in friction during the pump plunger stroke, and the durability of the control slide is sharply reduced because of the load change occurring at every plunger stroke.

SUMMARY OF THE INVENTION

The fuel injection pump according to the invention, provides very great durability and service life of the control slide because of the relatively small surface of the control recess in the pump plunger, which surface is acted upon by pressure. Moreover, a preferred, relatively gradual pressure increase is achieved by means of the counterbore whose control edge controls the start of delivery when immersed in the slide. In addition, a quick drop in pressure is achieved during the control because of the central arrangement of the opening of the duct leading to the pump work space in the pump plunger, since unnecessary deflections of the control quantity between the duct in the pump plunger and the control borehole in the control slide are avoided to a great extent.

In an advantageous construction of the invention, any injection quantity delivery is prevented in the stop position of the pump plunger, even when the helical groove of the control recess is relatively flat, so that a reliable stopping of the internal combustion engine is also ensured in this case, as in the prior art. Finally, it has proved advantageous that the manufacturing of the cylindrical counterbores or pocket boreholes in the skirt of the pump plunger is less expensive than the production of elongated grooves.

BRIEF DESCRIPTION OF THE DRAWINGS

Three embodiment examples of the subject matter of the invention are shown in the drawing and described in more detail in the following.

DESCRIPTION OF THE PREFERRED EMBODIMENTS

Figure 1:
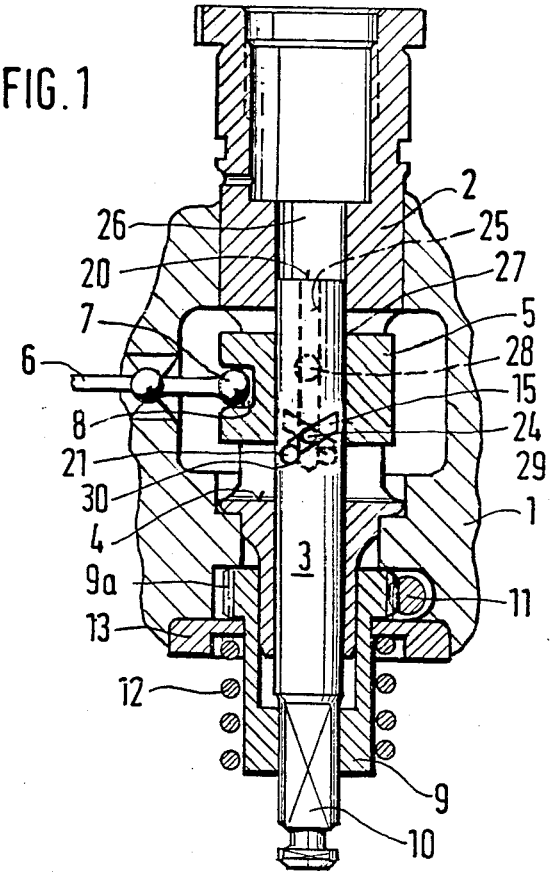
FIG. 1 shows a portion of a fuel injection pump in cross section.

Usually, a plurality of cylinder liners 2 are inserted in a row in a housing 1 of a fuel injection pump, pump plungers 3 being driven in these cylinder liners 2 by means of a camshaft, not shown, for its axial movement. A recess 4, which receives a control slide 5, which is axially displaceable on the pump plunger 3, is provided in the cylinder liner 2. The control slide 5 can be axially adjusted by means of a lever 6 for changing the time of the start of delivery, the lever 6 being supported in the housing; this lever engages with a ball head 7 in a groove 8 of the control slide 5 for this purpose.

In order that the pump plunger 3 rotates in a determined angular area, the end of the pump plunger 3 on the drive side engages with a flattened portion 10 in a rotatable bushing 9 so as to be axially displaceable. In its upper portion, this bushing 9 has a toothed ring **9*a* in which a toothed rack 11 engages, the latter serving as a control rod. Of course, some other device can also serve as a rotating mechanism. By means of a spring 12, which is supported at a spring disk 13, the pump plunger 3** is held at a roller tappet by means of a second spring disk in a manner which is known and, for this reason, not shown; the roller tappet is driven by a cam of the camshaft.

Two helical grooves 15, which extend at a determined angle relative to the longitudinal axis of the pump plunger 3 and have a level base 16 and two parallel, diagonal control edges 17, 18, are incorporated on the outer surface area of the pump plunger 3 in an axially symmetrical manner as control recesses. A cylindrical counterbore 21 is arranged in each end area 19 of the two helical grooves 15, which end area is remote of the working front side 20 of the pump plunger 3. The counterbores 21 have a diameter which is equal to or greater than the width of the helical grooves 15. The surface of the counterbores 21 partially overlap with the end area 19 of the helical grooves 15, for example, by one fourth to one third. Their depth is so great that their outer circumference intersects the base 16 of the helical grooves 15. The central axis of the counterbores 21 extends radially relative to the pump plunger 3 and is preferably arranged at the level of an imaginary corner point 22 which is as remote as possible from the working front side 20 of the pump plunger 3. In any case, the counterbores 21 must be arranged in such a way that the start of delivery is determined not by the corner point **22*a*, but by the boundaries of the counterbores 21 at the drive end, which are formed by a curve 30. (The end area 19** is no longer visible and is therefore indicated in a dash-dot line).

A cross hole 24 radially penetrates the pump plunger 3 in the middle of the base 16 of the helical grooves 15, a pocket borehole 25, which proceeds from the working front side 20 and extends axially in the pump plunger 3, opens into this cross hole 24. The cross hole 24 and the pocket borehole 25 form a duct between the helical grooves 15 and the pump work space 26 which is defined by the front side 20 of the pump plunger 3.

Two coaxial, radial control boreholes 28, which are located opposite one another, are arranged in the control slide 5 and cooperate with the control edge 17 of the helical grooves 15 in the vicinity of the working front side 20 of the pump plunger 3 in order to determine the injection quantity, particularly for controlling the end of delivery during the delivery stroke. Compared to known control boreholes, these control boreholes 28 have a considerably greater diameter, which ensures a quick flow of fuel from the pump work space 26 and prevents a renewed control with corresponding secondary delivery from taking place after the end of delivery. In contrast, the start of delivery is controlled by means of the complete immersion of the counterbores 21 in the control slide 5 and can be adjusted by means of the axial displacement of the control slide 5 on the pump plunger 3.

The fuel injection pump, according to the invention, works as follows: If the pump plunger 3 occupies the bottom dead center position shown in FIG. 1, the counterbores 21, which pass into the helical grooves 15, are exposed by the control slide 5 so that fuel can flow into the pump work space 26 along the duct formed by the cross hole 24 and the pocket borehole 25 in a virtually unthrottled manner. As soon as the delivery stroke of the pump plunger 3 commences, the curve 30, which is as far away as possible from the working front side 20 of the pump plunger 3 and forms a control edge, immerses sooner or later into the control slide 5, depending on the axial position of the control slide 5. As soon as the curve 30 has passed the lower front edge 29 of the control slide 5, the pressure required for the injection can be built up in the pump work space 26 and the injection delivery can commences. A relatively gradual increase in pressure, desirable per se, takes place at the start of delivery because of the construction of the control edge as a curve 30. The delivery takes place until the control borehole 28 of the control slide 5 is controlled by means of the helical grooves 15, so that the injection is interrupted by means of a drop in pressure. As the stroke of the pump plunger 3 continues until its top dead center, the fuel flows from the pump work space 26 through the pocket borehole 25, the cross hole 24, the helical grooves 15 and the control boreholes 28, back to the suction side of the pump. Since the cross hole 24 opens into the base 16 of the helical grooves 15 in a centric manner, a direct flow of fuel is made possible without disturbing influences within the helical grooves, so that a quick drop in pressure is ensured. After a determined axial position of the control slide 5 is reached, the end area 23 of the helical grooves 15, which end area 23 is next to the working front side 20 of the pump plunger 3, emerges from the top of the control slide 5, and the upper front edge 27 partially exposes the helical grooves 15 before the control edges 18 can again close the control boreholes 28.

Figure 5:
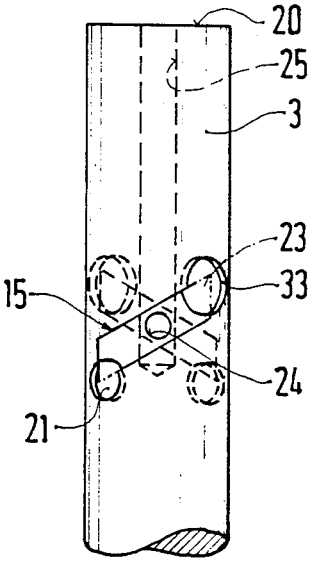
FIG. 5 shows a partial view of a pump plunger corresponding to FIG. 2, but for the second embodiment example.

In the second embodiment example according to FIG. 5, which substantially agrees with what was described previously and in which identical parts are therefore designated with the same reference numbers, a cylindrical counterbore 33 is likewise arranged in the end area 23 of the helical grooves 15 which is closest to the working from side 20. This counterbore 33 also partially overlaps the end area of the helical groove 15, which end area lies closest to the working front side 20, and passes into this helical groove 15. A large portion of this counterbore 33 extends beyond the end area 23 toward the working front side 20 of the pump plunger 3. This construction of the helical grooves 15 effects a zero delivery in the stopped rotational position of the pump plunger 3, in which the counterbores 33 which are close to the pump work space 26 overlap with the control boreholes 28 of the control slide 5 during the stroke of the pump plunger 3, even when the helical grooves 15 have a small pitch, since the counterbores 33 reach the control boreholes 28 before the counterbores 21 remote of the pump work space are immersed in the annular slide 5, so that no pressure build-up takes place during the pump plunger stroke. Helical grooves which are steeper in practice are simulated by means of the additional counterbores 33 close to the pump work space 26.

Figure 6:
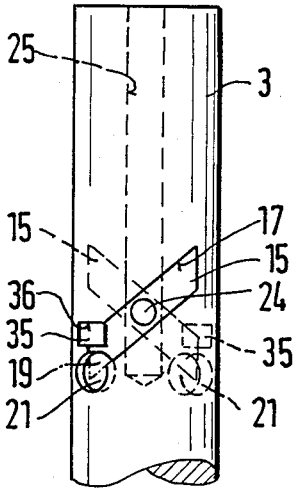
FIG. 6 shows an constructional variant of the pump plunger shown in FIG. 2 for the third embodiment example.
Figure 2:
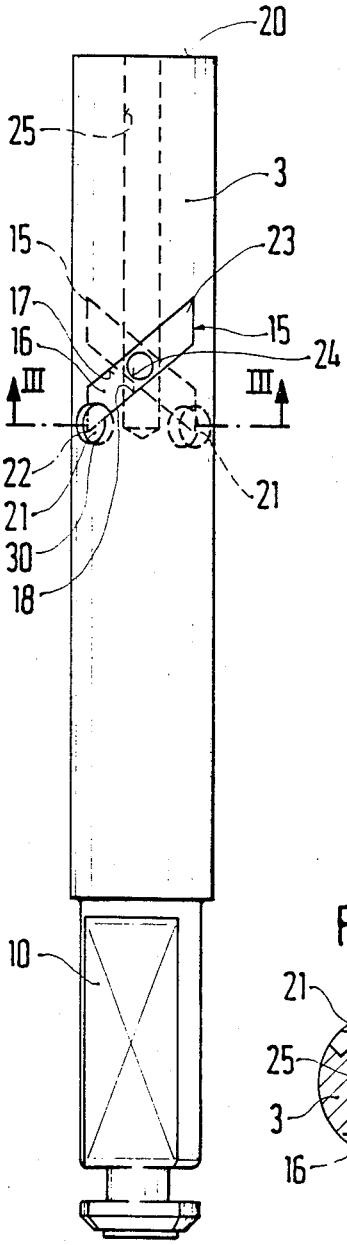
FIG. 2 shows a pump plunger of the fuel injection pump, according to FIG. 1, in enlarged scale.

The third embodiment example, which is shown in FIG. 6, differs from the previously described embodiment examples only with respect to the construction of the control edge. Like the pump plunger described with reference to FIG. 2, the pump plunger 3, shown in a partial view in FIG. 6, has relatively steep helical grooves 15 and the cylindrical counterbore 21 in the end area 19 remote of the pump work space 26. In contrast to the first embodiment example, there is a limiting groove 35 in the end area 19 of the helical groove 15 remote of the pump work space 26, which limiting groove 35 is at a right angle relative to the axis of the pump plunger 3, extends along a brief portion of the outer surface area, and opens laterally into the helical groove 15. This limiting groove 35 adjoins the counterbore 21 in the shown installation position of the pump plunger just above this counterbore 21 and, with its boundary which faces the pump work space 26, forms a horizontal control edge 36 into which the diagonal control edge 17 passes and which defines its effective length.

This step for defining the effective length of the control edge 17 is especially necessary if the helical groove 15 must be inserted in the outer surface area of the pump plunger at a relative steep angle because of the required large useful stroke between zero delivery and the maximum full-load delivery quantity. Because of the possible change in the start of delivery by means of the control slide 5, there is a risk that the pump delivery will take place close to the top dead center and, accordingly, at the small radius of the cam in this place if a delivery quantity which is greater than the maximum full-load is inadvertently adjusted, which inevitably results in damage to the cam. The provided operating regulating path can be exceeded in this way when the full-load stop is incorrectly set or by means of faulty functioning of the regulator. However, such damage to the cam is prevented by means of the horizontal control edge 36 which serves to limit the useful stroke and which is formed by the limiting groove 35.

If the risk described above also occurs already when the injection pumps have a relatively flat control groove pitch, as was described with reference to FIG. 5, then, of course, the described limiting grooves 35 can also be provided in the construction of the control recesses described there.

Since a clear reduction of the injection pressure is entirely sufficient for the safety function of the limiting groove 35 and, moreover, since the control quantity is relatively small shortly before the end of the stroke, the width and depth of the limiting groove can be clearly smaller than the corresponding dimensioning of the helical groove 15, which must carry away the overflow fuel quickly for a rapid end of injection. Thus, it is sufficient, e.g. with a width of the helical groove 15 amounting to three millimeters and a depth of 1.6 millimeters, that the width and depth of the limiting groove 35 be only half as large. Because of these minimized dimensions, the total surface area of the control recess is enlarged only to an inconsiderable degree, so that the third embodiment example also contributes to the solution of the problem according to the invention, namely to ensure the necessary durability of the control slide 12 by means of the smallest possible surface of the control recess.

Figure 4:
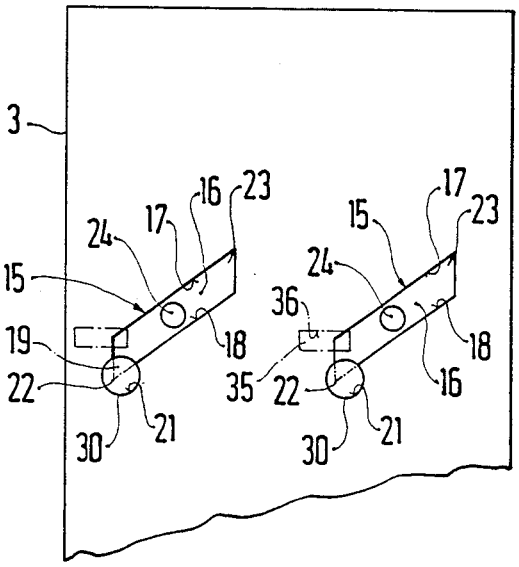
FIG. 4 shows a developed view of the outer surface area of the pump plunger in the control area according to FIG. 2.
Figure 3:
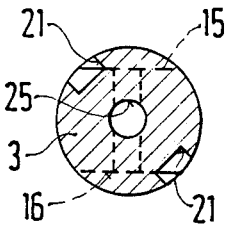
FIG. 3 shows the pump plunger, according to FIG. 2, in cross section in the plane III—III of FIG. 2.

For the purpose of elucidating the shape and position of the limiting groove 35, the latter was drawn in a dash-dot line in the developed view of the first embodiment example, shown in FIG. 4, (see this drawing).

In the described embodiment examples, the pump plunger 3 is arranged so as to be rotatable relative to the control slide 5 for the purpose of adjusting the delivery quantity. It is noted, in addition, that the control slide can be arranged not only axially, but also rotatably in a manner known per se. In this case, the pump plunger need not be rotated.

I claim:

1. A fuel injection pump for internal combustion engines, comprising:

at least one reciprocating pump plunger (3) defining a pump work space (26), said plunger (3) having an axis and an outer surface with a control recess, said plunger (3) having duct means (24, 25) communicating said pump work space (26) with said control recess, said control recess including a helical groove (15) and a cylindrical counterbore (21), said helical groove (15) having a control edge (17), a central area, and an end area (19), said helical groove extending at a predetermined angle relative to said axis of said plunger (3); and a control slide (5) axially displaceable on said plunger and having a front edge (29) for controlling a start of delivery of the fuel to be injected when said control recess is fully immersed in said control slide (5) and a radial control borehole (28) cooperating with said control edge (17) to control an end of the delivery of the fuel to be injected, said plunger (3) and said control slide (5) being rotatable relative to each other so as to change a delivery quantity of the fuel, said cylindrical counterbore (21) adjoining said end area (19) of said helical groove (15) remote from said pump work space (26) and partially overlapping said end area (19), said duct (24, 25) being formed to open into said central area of said helical groove (15), said end area (19) of said helical groove (15) being remote from said pump work space (26), said counterbore (21) having a width that is at least the same width as that of said helical groove (15) and widens said end area (19) of said helical groove (15), said end area (19) of said helical groove (15) having a corner (22) spaced further from said pump work space (26) than a remainder of said helical groove (15), said counterbore (21) having a center approximately at a height the same as that of said corner (22).

2. A fuel injection pump for internal combustion engines, comprising:

at least one reciprocating pump plunger (3) defining a pump work space (26), said plunger (3) having an axis and an outer surface with a control recess, said plunger (3) having duct means (24, 25) communicating said pump work space (26) with said control recess, said control recess including a helical groove (15) and a cylindrical counterbore (21), said helical groove (15) having a control edge (17), a central area, and an end area (19), said helical groove extending at a predetermined angle relative to said axis of said plunger (3);

a control slide (5) axially displaceable on said plunger and having a front edge (29) for controlling a start of delivery of the fuel to be injected when said control recess is fully immersed in said control slide (5) and a radial control borehole (28) cooperating with said control edge (17) to control an end of the delivery of the fuel to be injected, said plunger (3) and said control slide (5) being rotatable relative to each other so as to change a delivery quantity of the fuel, said cylindrical counterbore (21) adjoining said end area (19) of said helical groove (15) remote from said pump work space (26) and partially overlapping said end area (19), said duct (24, 25) being formed to open into said central area of said helical groove (15), said helical groove (15) having an end area (23) closer to said pump work space (26) than a remainder of said helical groove (15); and a second cylindrical counterbore (33) adjoining said end area (23) of said helical groove (15), said second cylindrical counterbore (33) partially covering said end area (23).

3. The fuel injection pump according to claim 2, wherein said second counterbore (33) extends from said helical groove (15) to said pump work space (26) in a curved manner.

4. A fuel injection pump for internal combustion engines, comprising:

at least one reciprocating pump plunger (3) defining a pump work space (26), said plunger (3) having an axis and an outer surface with a control recess, said plunger (3) having duct means (24, 25) communicating said pump work space (26) with said control recess, said control recess including a helical groove (15) and a cylindrical counterbore (21), said helical groove (15) having a control edge (17), a central area, and an end area (19), said helical groove extending at a predetermined angle relative to said axis of said plunger (3); and a control slide (5) axially displaceable on said plunger and having a front edge (29) for controlling a start of delivery of the fuel to be injected when said control recess is fully immersed in said control slide (5) and a radial control borehole (28) cooperating with said control edge (17) to control an end of the delivery of the fuel to be injected, said plunger (3) and said control slide (5) being rotatable relative to each other so as to change a delivery quantity of the fuel, said cylindrical counterbore (21) adjoining said end area (19) of said helical groove (15) remote from said pump work space (26) and partially overlapping said end area (19), said duct (24, 25) being formed to open into said central area of said helical groove (15), said end area of said helical groove (15) is spaced remote from said pump work space (26), said pump plunger (3) having an axis, said helical groove (15) having a limiting groove (35) in said end area (19), said limiting groove (35) adjoining said cylindrical counterbore (21) and being arranged perpendicular to said axis of said pump plunger (3), said limiting groove (35) extending along a portion of said outer surface and opens laterally into said helical groove (15), said limiting groove (35) having a horizontal control edge (36) defining an effective length of said control edge (17).

5. A fuel injection pump for internal combustion engines, comprising:

at least one reciprocating pump plunger (3) defining a pump work space (26), said plunger (3) having an axis and an outer surface with a control recess, said plunger (3) having duct means (24, 25) communicating said pump work space (26) with said control recess, said control recess including a helical groove (15) and a cylindrical counterbore (21), said helical groove (15) having a control edge (17), a central area, and an end area (19), said helical groove extending at a predetermined angle relative to said axis of said plunger (3); and a control slide (5) axially displaceable on said plunger and having a front edge (29) for controlling a start of delivery of the fuel to be injected when said control recess is fully immersed in said control slide (5) and a radial control borehole (28) cooperating with said control edge (17) to control and end of the delivery of the fuel to be injected, said plunger (3) and said control slide (5) being rotatable relative to each other so as to change a delivery quantity of the fuel, said cylindrical counterbore (21) adjoining said end area (19) of said helical groove (15) remote from said pump work space (26) and partially overlapping said end area (19), said duct (24, 25) being formed to open into said central area of said helical groove (15), so that no vertical groove which forms a stop groove is needed.

6. The fuel injection pump according to claim 9, wherein said end area (19) of said helical groove (15) is remote from said pump work space (26), said counterbore (21) having a width that is at least the same width as that of said helical groove (15) and widens said end area (19) of said helical groove (15).

7. The fuel injection pump according to claim 6, wherein said pump plunger (3) has a working front side (20) facing said pump work space (26), said end area (19) of said helical groove (15) having a corner (22) spaced further from said pump work space (26) than a remainder of said helical groove (15), said counter bore (21) having a boundary forming a curve (30), said working front side (20) of said pump plunger (3) being spaced from said boundary at a distance that is greater than from said corner (22).

8. The fuel injection pump according to claim 5, wherein said counterbore (21) has an axis extending radially relative to said pump plunger (3).

* * * * *